United States Patent [19]

Zoleski et al.

[11] Patent Number: 4,681,694

[45] Date of Patent: Jul. 21, 1987

[54] MARINE CRANKCASE LUBRICANT

[75] Inventors: Benjamin H. Zoleski, Beacon, N.Y.; Wheeler C. Crawford, Houston, Tex.; Rodney L. Sung, Fishkill, N.Y.

[73] Assignee: Texaco Inc., White Plains, N.Y.

[21] Appl. No.: 812,156

[22] Filed: Dec. 23, 1985

[51] Int. Cl.[4] ..... C10M 133/54; C10M 133/04

[52] U.S. Cl. ..... 252/51.5 R; 252/32.7 E; 252/39

[58] Field of Search ..... 252/51.5 R, 32.7 E

[56] References Cited

U.S. PATENT DOCUMENTS

| | | | |
|---|---|---|---|
| 4,382,006 | 5/1983 | Horodysky | 252/51.5 R X |
| 4,386,001 | 5/1983 | Zoleski et al. | 252/51.5 R X |
| 4,391,610 | 7/1983 | Sung et al. | 44/72 X |
| 4,409,000 | 10/1983 | LeSuer | 252/51.5 R X |
| 4,460,379 | 7/1984 | Sweeney et al. | 44/72 |
| 4,477,362 | 10/1984 | Steckel | 252/51.5 R |
| 4,486,324 | 12/1984 | Korosec | 252/32.7 E X |
| 4,539,125 | 9/1985 | Sato | 252/32.7 E |

*Primary Examiner*—William R. Dixon, Jr.
*Assistant Examiner*—Ellen M. McAvoy
*Attorney, Agent, or Firm*—Robert A. Kulason; James J. O'Loughlin; Vincent A. Mallare

[57] ABSTRACT

A crankcase lubricating oil composition for slow speed marine diesel engines characterized by having a Total Base Number from about 3 to 10 containing a mineral lubricating oil, an overbased calcium alkylphenolate, a zinc dihydrocarbyl dithiophosphate, an alkylated diphenylamine, and a rust-inhibiting amount of at least one dialkoxylated alkylpolyoxyalkyl primary amine.

9 Claims, No Drawings

MARINE CRANKCASE LUBRICANT

BACKGROUND OF THE INVENTION

This invention is concerned with a novel crankcase lubricating composition having rust inhibiting properties in large slow speed marine diesel engines.

One significant development in the shipping field is the trend away from steam turbine propulsion units in favor of large marine diesel engines which are increasingly subjected to hostile environment due to the use of low quality petroleum fuels.

The largest marine diesel engines used for ship propulsion are classified as slow speed marine diesel engines. These engines are unique both in their size and in their method of operation. The engines themselves are massive, the larger units approaching 2000 tons in weight and upwards of 100 feet long and 45 feet in height. Their output can reach 50,000 brake horsepower with engine revolutions ranging from about 100 to 125 revolutions per minute.

The slow speed marine diesel engines are unique in their design. Most notably, the crankcase of the large slow speed single acting 2-stroke crosshead type of engine is completely separate from the combustion zone of the engine, i.e. there is no direct communication between the combustion zone and the crankcase zone of this engine. This has led to the use of two different lubrication systems to lubricate a slow speed marine diesel engine. The cylinders in the combustion zone are lubricated with a highly basic 50 to 100 TBN lubricant which functions to counteract the high acidity generated by the use of a high sulfur residual fuel.

The problems encountered in the crankcase of a slow speed marine diesel engine relate to engine lubricant rust problems and water separation characteristics which are essential in a shipboard environment. The essential requirements for a crankcase lubricant for this engine include a rust inhibitor, an anti-wear additive, an oxidation-corrosion inhibitor and a demulsifying agent to maintain the operability and effectiveness of the lubricant.

The lubricant used in the crankcase of a slow speed cross-headed marine engine must protect the engine parts from rust. The rust originates from the reaction of water on ferrous metal parts and the water finds its way into this portion of the engine either through the products of fuel combustion or contamination from an outside water source which could be either fresh or sea (salt) water. The slow speed crankcase formulation, commercial/lubricant may contain a rust inhibitor for this reason; however, there have recently been several complaints that the product is hazy, and the cause of the haze has been identified as the rust inhibitor. The haze, as measured by Lumetron Turbidity measurements, can vary in severity depending on how the batch of rust inhibitor was formulated. Two samples of commercial lubricants had Lumetron values of 44 and 55 which are considered unsatisfactory. Thus, it is an object of the present invention to provide a rust inhibiting additive which renders crankcase oils clear as well as rust protective of marine engines.

DISCLOSURE STATEMENT

U.S. Pat. No. 4,391,610 discloses a dialkoxylated alkylpolyoxyalkyl primary amine and its use as a corrosion inhibitor for gasoline and alcohol/gasoline blends.

U.S. Pat. No. 4,460,379 discloses a dialkoxylated alkylpolyoxyalkyl primary amine and its use as a stabilizing agent for middle distillate fuel.

U.S. patent application, Ser. No. 803,689 discloses a method of preparing a dialkoxylated alkylpoly-oxyalkyl primary amine.

SUMMARY OF THE INVENTION

The crankcase oil composition of this invention has a Total Base Number (TBN) ranging from about 3 to about 10 and comprises: a major portion of mineral lubricating oil containing an overbased salt selected from the group consisting of calcium alkylphenolate or a sulfurized calcium alkylphenolate and mixtures thereof; a zinc dihydrocarbyl dithiophosphate; and dinonyldiphenylamine; and a minor rust-inhibiting amount of at least one dialkoxylated alkylpolyoxyalkyl tertiary amine represented by the formula:

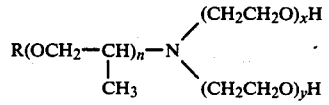

wherein R is an alkyl group of 1–30 carbons, preferably 6–20 carbons, and n is an integer of about 1 to about 6, preferably from about 1 to about 2 and x+y is about 2 to about 30, preferably from about 2 to about 20 and both x and y cannot be equal to 0.

The novel method of the invention involves operating a medium to high speed marine diesel engine by supplying the above-described lubricating oil composition to the crankcase lubrication system of the engine.

SPECIFIC EMBODIMENTS OF THE INVENTION

In a more specific embodiment of the invention, the crankcase lubricating composition of the invention has a Total Base Number (TBN) ranging from about 3 to about 10 and comprises:

(a) a major portion of a mineral lubricating oil containing from about 1 to about 5 wt.% of at least one overbased salt selected from the group consisting of calcium alkylphenolate or a sulfurized calcium alkylphenolate having a TBN of about 147 and mixtures thereof, from about 0.1 to about 1.0 wt.% of a zinc dihydrocarbyl dithiophosphate represented by the formula

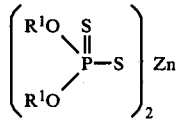

wherein $R^1$ is a ($C_3$–$C_{12}$) hydrocarbyl radical or a hydroxy substituted ($C_3$–$C_{12}$) hydrocarbyl radical, and from about 0.5 to aobut 3.0 wt.% of dinonyldiphenylamine; and (b) from about 0.05 to about 1.0 wt.% of, as a rust-inhibiting additive, a dialkoxylated alkylpolyoxy-alkyl tertiary amine

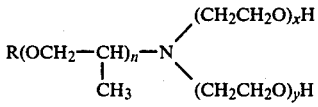

wherein R is a ($C_1$–$C_{30}$) alkyl, n is an integer of about 1 to about 6, and x+y is about 2 to about 30 and both x and y cannot be equal to 0.

The composition can also contain minor amount of an antifoam agent such as a dialkyl silicone.

In general, the rust reducing compounds of the inventions are synthesized as described in U.S. patent application, Ser. No. 803,689 by reacting an alkanol with an alkylene amine resulting in a polyoxyalkylated alkanol which is catalytically converted to alkylpolyoxyalkyl tertiary amine with ethylene oxide at 150° C./20 psi, thus providing the instant invention dialkoxylated alkylpolyoxyalkyl tertiary amines.

The reaction proceeds as follows:

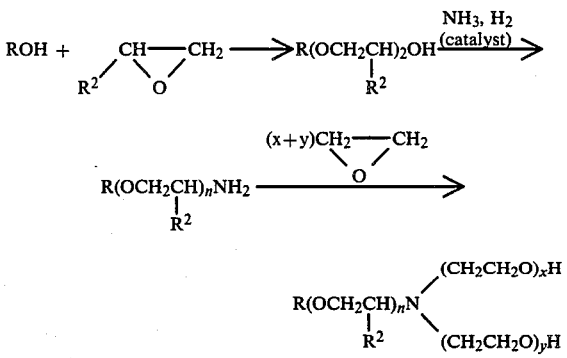

wherein R is a ($C_1$–$C_{30}$) alkyl group; $R^2$ is H, $CH_3$, or $C_2H_5$; n is an integer of about 1 to about 6.

The preferred rust reducing components, as represented by the above product formula, for the lubricating oil of the invention are those where R is a ($C_{10}$–$C_{20}$) alkyl group. These are effective in a range from about 0.1 to 5 weight percent based on the total lubricating oil composition. However, it is preferred to employ from about 0.5 to about 2 weight percent of the derivative based on the weight of the lubricating oil with the most preferred concentration ranging from about 0.75 to 1.5 weight percent.

The present rust reducing additives may be surfactants produced and marketed by Texaco Chemical Company of Houston, Tex., in an Experimental Surfactant M series. These surfactants are illustrated as follows:

I. Experimental Surfactant M-302

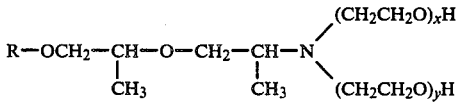

R = a ($C_{10}$–$C_{12}$) alkyl group
x + y = 2

II. Experimental Surfactant M-305

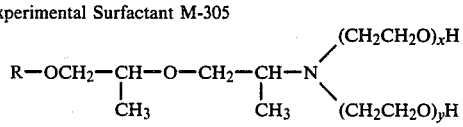

-continued

R = a ($C_{10}$–$C_{12}$) alkyl group
x + y = 5

III. Experimental Surfactant M-310

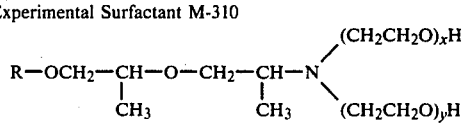

R = a ($C_{10}$–$C_{12}$) alkyl group
x + y = 10

IV. Experimental Surfactant M-315

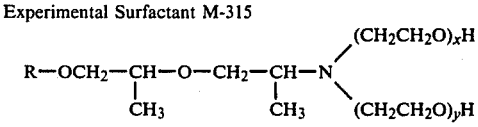

R = a ($C_{10}$–$C_{12}$) alkyl group
x + y = 15

V. Experimental Surtfactant M-320

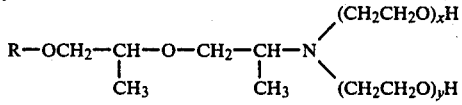

R = a ($C_{10}$–$C_{12}$) alkyl group
x + y = 20

The second essential component of the crankcase lubricating oil composition of the invention is an overbased calcium alkylphenolate or a sulfurized overbased calcium alkylphenolate in a sufficient amount to provide a Total Base Number ranging from 3 to 10 in the finished crankcase lubricating oil composition. The Total Base Number (TBN) is a measure of alkalinity determined according to the test procedure outlined below in the summary description of the Salt Water Rust Test, i.e., ASTM D-665.

SUMMARY OF SALT WATER RUST TEST (ASTM D-665)

In this test, a mixture of 300 mL of the oil under test is stirred with 30 mL of distilled water or synthetic sea water, as required, at a temperature of 60° C. (14° F.) with a cylindrical steel specimen completely immersed therein. It is customary to run the test for 24 hours; however, the test period may, at the discretion of the contracting parties, be for a shorter or longer period. After the testing, the specimen is observed for signs of rusting and, if desired, degree of rusting.

Also, according to the present invention, the Lumetron Turbidity (L.T.) of the lubricant additive is determined according to the test procedure outlined below in the summary description of the Lumetron Turbidity Test.

SUMMARY OF LUMETRON TURBITY TEST

In this test, the sample, contained in a 1 cm sample cell, is placed at the extreme right side of the Lumetron colorimeter sample holder compartment and the instrument is balanced with the slide wire dial set on 100. The sample is then moved to the extreme left of the compartment and the instrument is rebalanced with the slide wire dial. This last reading subtracted from 100 minus the cell correction reading gives the Lumetron Turbidity (L.T.) of the lubricant additive.

The results of various tests made on the improved Marine Crankcase Oil are provided below in Table I.

TABLE I

| Oil | Laboratory Test Performance Data For 6TBN Marine Crankcase Oils | | | | | | |
|---|---|---|---|---|---|---|---|
| | Marine Crankcase Oil | Marine Crankcase Oil (Base Oil) (No Rust Inhibitor) | Modified Marine Crankcase Oil | Modified Marine Crankcase Oil | Modified Marine Crankcase Oil | Modified Marine Crankcase Oil | Modified Marine Crankcase Oil |
| Example | A | B | C | D | E | F | G |
| Composition, wt. % | | | | | | | |
| SNO-20G (1) | 39.30 | 39.30 | 39.30 | 39.30 | 39.30 | 39.30 | 39.30 |
| SNO-50 (2) | 55.80 | 56.15 | 55.15 | 55.15 | 55.15 | 55.15 | 55.15 |
| Oronite 218A (3) | 3.60 | 3.60 | 3.60 | 3.60 | 3.60 | 3.60 | 3.60 |
| TLA-111B (4) | 0.65 | 0.65 | 0.65 | 0.65 | 0.65 | 0.65 | 0.65 |
| Vanlube NA (5) | 0.30 | 0.30 | 0.30 | 0.30 | 0.30 | 0.30 | 0.30 |
| Dimethyl Silicone, ppm | 150 | 150 | 150 | 150 | 150 | 150 | 150 |
| Surfonic N-60 (6) | 0.35 | — | — | — | — | — | — |
| Surfactant, M series (7) | — | — | 1.00 (9) | 1.00 (10) | 1.00 (11) | 1.00 (12) | 1.00 (13) |
| TESTS | | | | | | | |
| Lumetron Turbidity (8) | 55 | 6 | 5 | 29 | 26.5 | 29 | 40.0 |
| ASTM Salt Water Rust Test [D665] (8) | — | Fail | Pass | Pass | Pass | Pass | Pass |

(1) Solvent Neutral Oil, Parafinic base stock, viscosity of 36–50 cSt @ 40° C. and 5.7–9.3 cSt @ 100° C.
(2) Solvent Neutral Oil, Parafinic base stock, viscosity of 216–245 cSt @ 40° C. and 17.4–18.6 cSt @ 100° C.
(3) Overbased sulfurized calcium alkiphenate of 147 TBN (sold under the trademarked name of Oromite 218A).
(4) Zinc salt of mixed ($C_2$–$C_4$) alcohols/$P_2S_5$ reaction product; 11.5% zn.
(5) Dinonyldiphenylamine antioxidant.
(6) Nonylphenol ethoxylated with 6 ethylene oxide moieties.
(7) Surfactant, M series, as described above.
(8) Same description of the procedures described above.
(9) Surfactant, M-302.
(10) Surfactant, M-305.
(11) Surfactant, M-310.
(12) Surfactant, M-315.
(13) Surfactant, M-320.

Examples for the synthesis of the present rust reducing additives for crankcase lubricants are provided below. These Examples are for only illustration and not limiting the present invention.

EXAMPLE I 285 grams (1 mole) of a mixture of n-decyl and dodecyl di-oxypropylene amine (Jeffamine M-300) having the following formula:

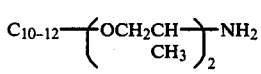

were heated to 150° C. in a reaction vessel. Then 88 grams (2 moles) of ethylene oxide were slowly added over a 2 hour period. The temperature was maintained and the reaction continued for approximately 30 minutes after the addition of ethylene oxide was complete. Analysis of the resulting product shows that it is 2.7 meq/gram total amines and has a structure corresponding to the following formula:

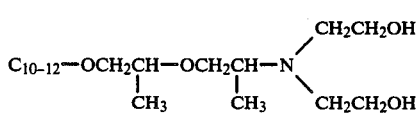

EXAMPLE 2

To 373 grams (1 mole) of Example I in a reaction vessel 0.5 grams of KOH was added. The system was flushed with nitrogen and the reaction mixture was heated to about 100° to 150° C. to remove water. Slowly over a 1.5 hour period, 132 grams (3 moles) of ethylene oxide were added to the reaction vessel at 115° to 140° C. The temperature was maintained and the reaction continued approximately 0.5 hours after the ethylene oxide addition was complete. Then the KOH catalyst was neutralized and the resulting salts removed. Analysis of the remaining product indicates that it contains approximately 2 meq/g total amines and has a structure corresponding to the following formula:

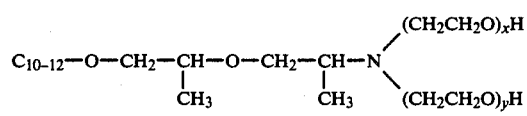

where the sum of x+y is 5.

EXAMPLE 3

To 373 grams (1 mole) of Example 1 in a reaction vessel 0.5 grams of KOH was added. The system was flushed with nitrogen and the reaction mixture was heated to about 100° to 150° C. to remove water. Slowly over approximately 3.5 hours, 352 grams (8 moles) of ethylene oxide were added to the reaction vessel at from 115° to 140° C. The temperature was maintained and the reaction continued approximately 0.5 hours after the ethylene oxide addition was complete. Then the KOH catalyst was neutralized and the resulting salts were removed. Analysis of the remaining product indicates that it contained approximately 1.35 meq/gram total amines and had a structure corresponding to the following formula:

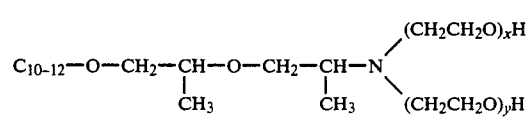

wherein the sum of x+y is 10.

EXAMPLE 4

To 373 grams (1 mole) of Example 1 in a reaction vessel, 0.5 gram of KOH was added. The system was flushed with nitrogen and the reaction mixture was heated to about 100° to 150° C. to remove water. Slowly over approximately 5 hours, 572 grams (13 moles) of ethylene oxide were added to the reaction vessel at from 115° to 140° C. The temperature was maintained and the reaction continued approximately 0.5 hours after the ethylene oxide addition was complete. Then the KOH catalyst was neutralized and the resulting salts were removed. Analysis of the remaining product indicates that it contained approximately 1.0 meq/gram total amines and had a structure corresponding to the formula:

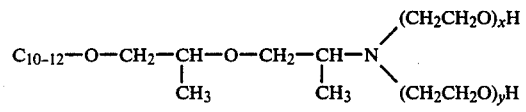

wherein the sum of x+y is 15.

EXAMPLE 5

To 373 grams (1 mole) of Example 1 in a reaction vessel, 0.5 gram of KOH was added. The system was flushed with nitrogen and the reaction mixture was heated to about 100° to 150° C. to remove water. Slowly over approximately 6 hours, 792 grams (18 moles) of ethylene oxide were added to the reaction vessel at from 115° to 140° C. The temperature was maintained and the reaction continued approximately 0.5 hours after the ethylene oxide addition was complete. Then the KOH catalyst was neutralized and the resulting salts were removed. Analysis of the remaining product indicated that it contained approximately 0.75 meq/gram total amines and had a structure corresponding to the formula:

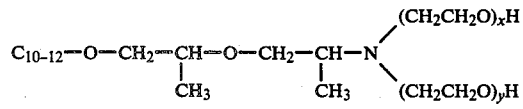

wherein the sum of x+y is 20.

In general, calcium alkyphenolates are prepared by reacting a alkylphenol in which the alkyl radical has from 5 to 50 carbon atoms, preferably from 10 to 20 carbon atoms with a basic calcium compound such as calcium oxide, calcium hydroxide, calcium alkoxyalkoxide, or calcium carbonate to effect the formation of the overbased calcium alkylphenolate. If the corresponding sulfurized compound is desired, sulfur is reacted with the calcium alkylphenolate prior to or after it has been coverted to its overbased form. Methods for making overbased calcium alkylphenolates are well known and do not constitute a part of this invention. Specific details for preparing overbased calcium alkylphenolates and sulfurized overbased calcium alkylphenolates are disclosed in U.S. Pat. Nos. 3,779,920 and 3,761,414 and the disclosures in these references are incorporated herein by reference.

The prescribed alkylphenolate is employed in the crankcase lubricant of the invention in a concentration sufficient to provide a Total Base Number form about 3 to 8, and preferably from 5 to 6, in the finished lubricating oil composition. In general, this will require from about 1 to 5 weight percent of the alkylphenolate salt on a neat basis.

The essential zinc dithiophosphate component of the lubricating oil is represented by the formula:

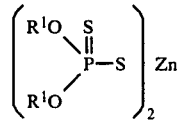

in which $R^1$ is a hydrocarbyl radical or a hydroxy-substituted hydrocarbyl radical having from 3 to 12 carbon atoms. The preferred zinc dithiophosphates are those in which R represents an alkyl radical having from 4 to 8 carbon atoms. Examples of suitable compounds include zinc isobutyl 2-ethyl-hexyl dithiophosphate, zinc di(2-ethylhexyl)dithiophosphate, zinc isoamyl 2-ethylhexyl dithiophosphate, zinc di(phenoxyethyl)dithiophosphate and zinc di(2,4-diethylphenoxyethyl)dithiophosphate. In general, these compounds are employed in the oil composition in a concentration ranging form about 0.1 to 1.0 weight percent with a preferred concentration ranging from about 0.5 to 1.5 percent. These compounds can be prepared from the reaction of a suitable alcohol or mixture of alcohols with phosphorus pentasulfide. They are illustrated in U.S. Pat. Nos. 2,344,395, 3,293,181, and 3,732,167 which are incorporated herein by reference.

The prescribed lubricating oil composition of the invention may contain additional known lubricating oil additives. An oxidation inhibitor which can be beneficially employed is an alkylated diphenylamine represented by the formula:

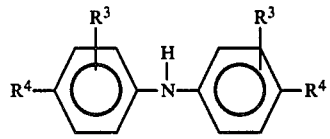

in which $R^3$ is an alkyl radical having from 1 to 4 carbon atoms and $R^4$ is an alkyl radical having from about 4 to 16 carbon atoms. A more preferred compound is one in which R' is a tertiary alkyl hydrocarbon radical having form 6 to 12 carbon atoms. Examples of typical compounds include 2,2'-diethyl, 4,4'-tert.dioctyldiphenylamine, 2,2-diethyl, 4,4-tert.dioctylphenylamine 2,2'-diethyl, 4-tert.octyldiphenylamine, 2,2; dimethyl-4,4'tert.dioctyldiphenylamine, 2,5-diethyl, 4,4'-tert.-dihexyldiphenylamine, 2,2,2',2'-tetraethyl, 4,4'-tert-.didodecyldiphenylamine and 2,2' dipropyl 4,4'-tert-.dibutyldiphenylamine. Mixture of the foregoing compounds can be employed with equal effectiveness. The alkylated diphenylamine is normally employed in an oil composition in a concentration ranging from about 0.1 to 2.5 percent weight based on the weight of the lubricating oil composition, with the preferred concentration being from about 0.25 to 1.0 percent.

The hydrocarbon oil which can be employed to prepare the diesel lubricating oil composition of the invention includes naphthenic base, paraffinic base and mixed base mineral oils, lubricating oil derived from coal products and synthetic oils, e.g., alkylene polymers such as polypropylene and polyisobutylene of a molecular weight of between about 250 and 2500. Advantageously, a lubricating base oil having a lubricating oil viscosity SUS at 100° F. of between about 40 and 1500, preferably between 100 and 1200, are normally employed for the lubricant composition. The most preferred lubricating viscosity for a crankcase lubricating oil composition is a viscosity ranging from about 56 to 68 SUS at 210° F. The hydrocarbon oil will generally constitute from about 80 to 90 weight percent of the total lubricating oil composition with the preferred concentration range being from about 82 to about 88 weight percent.

The improvement in rust prevention brought about by the novel crankcase lubricant composition of the invention was demonstrated in the Lumetron Turbidity Test & ASTM Salt Water Rust Test (D-665), as described above, and shown above in the results of Table I.

We claim:

1. A crankcase lubricating oil composition having a Total Base Number ranging from about 3 to about 10 and comprising:

(a) major portion of a mineral lubricating oil containing from about 1 to about 5 wt.% of at least one overbased salt selected from the group consisting of calcium alkylphenolate or a sulfurized calcium alkylphenolate having a TBN of about 147 and mixtures thereof, from about 0.1 to about 1.0 wt.% of a zinc dithiophosphate

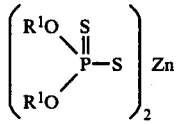

wherein $R^1$ is a ($C_3$–$C_{12}$) hydrocarbyl radical or a hydroxy substituted ($C_3$–$C_{12}$) hydrocarbyl radical, and from about 0.5 to about 3.0 wt.% of dinonyldiphenylamine; and (b) from about 0.1 to about 5.0 to about 1 wt.% of as, a rust-inhibiting additive, a dialkoxylated alkylpolyoxyalkyl tertiary amine

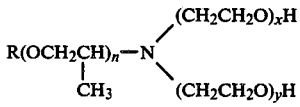

wherein R is a ($C_1$–$C_{30}$) alkyl, n is an integer of about 1 to about 6, and x+y is about 2 to about 30 where both x and y cannot be equal to 0.

2. The crankcase lubricating oil composition of claim 1, wherein from about 0.5 to about 2.0 wt.% of said tertiary amine is contained in said lubricating oil composition.

3. The crankcase lubricating oil composition of claim 1, wherein the concentration of said tertiary amine ranges from about 0.75 to about 1.5 wt.%.

4. The crankcase lubricating oil of claim 1, wherein n is an interger of about 1 to about 2 and x+y is about 2 to about 20.

5. The crankcase lubricating oil composition of claim 1, wherein said tertiary amine is represented by the formula:

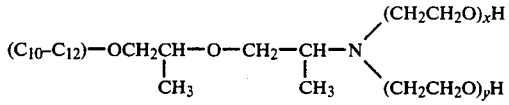

where x+y=2.

6. The crankcase lubricating oil composition of claim 1, wherein said tertiary amine is represented by the formula:

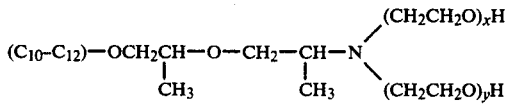

where x+y=5.

7. The crankcase lubricating oil composition of claim 1, wherein said tertiary amine is represented by the formula:

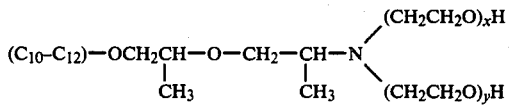

where x+y=10.

8. The crankcase lubricating oil composition of claim 1, wherein said tertiary amine is represented by the formula:

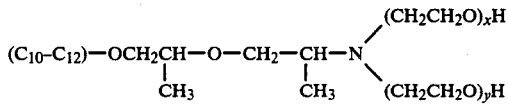

where x+y=15.

9. The crankcase lubricating oil composition of claim 1, wherein said tertiary amine is represented by the formula:

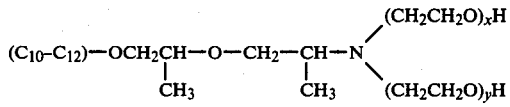

where x+y=20.

* * * * *